United States Patent [19]

Brooks

[11] 4,125,852

[45] Nov. 14, 1978

[54] DENTAL FILM CARRIAGE

[76] Inventor: Louis E. Brooks, 14 Lawson La., Great Neck, N.Y. 11023

[21] Appl. No.: 802,274

[22] Filed: May 31, 1977

[51] Int. Cl.[2] ..... G03D 3/10

[52] U.S. Cl. ..... 354/322; 354/340

[58] Field of Search ..... 354/311, 312, 315, 316, 354/319, 320, 322, 331, 337, 338, 339, 340, 345

[56] References Cited

U.S. PATENT DOCUMENTS

| | | | |
|---|---|---|---|
| 3,712,206 | 1/1973 | Schmidt | 354/338 |
| 3,882,525 | 5/1975 | Zwettler | 354/316 |
| 3,882,527 | 5/1975 | Sawada | 354/322 |
| 4,032,943 | 6/1977 | Zwettler | 354/312 |

*Primary Examiner*—L. T. Hix
*Assistant Examiner*—Alan Mathews
*Attorney, Agent, or Firm*—John T. Matlago

[57] ABSTRACT

Carriages are provided for conveying odd-size dental film chips through a basic processor and dryer which have been especially adapted for advancing standard size film chips by their edges along vee-grooved paths extending therethrough. The carriages comprise frames for holding the odd-size film chips and support members transversely disposed on the ends of the frames. The support members are in the form of thin plates of a size such that they can be advanced along the vee-grooved paths of the processor and dryer in the same manner as the standard size film chips. The frames of the carriages are provided with opposing pairs of vee-grooves which engage the edges of odd-size film chips when slightly bowed. To enable the odd-size film chips to be dried by the same dryer used for drying the standard size film chips, the vee-grooves of the frames are shaped to reduce the size of the globules of rinse solution that are retained thereon.

14 Claims, 19 Drawing Figures

DENTAL FILM CARRIAGE

BACKGROUND OF THE INVENTION

This invention relates to film processing apparatus and more particularly to carriages for use in conveying film chips through a film processor.

A processor for automatically processing batches of dental X-ray film chips of a standard size has been previously disclosed in U.S. Pat. No. 3,882,525 issued to Ernst Zwettler. The processor includes a film chip transport unit comprised of a continuous channel having successive downwardly and upwardly curved portions which extend down into and out of tanks of solutions needed for developing the film chips. The inner lateral surfaces of the channel are provided with paths formed by opposing pairs of vee-grooves which loosely engage the side edges of vertically disposed film chips introduced into the channel. Mounted to rotate in each downwardly curved portion of the channel is a lower lifter, and mounted to rotate in each upwardly curved portion of the channel is an upper lifter. By such an arrangement, film chips introduced into the entrance passage of the channel freely slide by gravity along the downwardly extending portions of their paths and are lifted by the lower and upper rotating lifters along the upwardly extending portions of their paths. Upon being lifted from the last tank, the film chips are pushed into a dryer compartment where they are engaged between pairs of vee-grooves provided on spaced rollers which are continuously being rotated to advance the film chips.

Although the film chip processor disclosed in the aforementioned patent is admirably suited for automatically processing film chips of a standard size which correspond to approximately 85% of the X-ray film chips used by a dentist, there are several other sizes of film chips, hereinafter referred to as odd-size film chips, which cannot be processed by the processor.

SUMMARY OF THE INVENTION

In accordance with the present invention, carriages are provided to enable the film chip processor disclosed in the aforementioned patent to automatically process the odd-size film chips. These carriages are constructed to hold the film chips by contacting them by their edges so as not to damage the emulsion on their surfaces. Furthermore, these carriages are provided with support members in the form of stiff, thin plates having width dimensions corresponding to the widths of the standard size film chips. Thus, when the carriages are dropped into the entrance passage of the channel their support members are able to freely slide by gravity down along the downwardly extending portions of the channel and to be lifted by the rotating lower and upper lifters up along the upwardly extending portions of the channel in the same manner as the standard size film chips.

A preferred embodiment of the carriages used for odd-size film chips which are shorter in length than the standard size film chips comprises a holder in the form of a rectangular frame having the support members in the form of stiff thin plates secured on each end thereof. The inner opposite sides of the rectangular frames are provided with pairs of opposing vee-grooves which are spaced to firmly engage the edges of odd-size film chips when they are slightly bowed lengthwise. A carriage used for odd-size film chips which are longer in length than the standard size film chips is provided by employing a single support member in the form of a stiff plate, as above referred to, which has a rectangular opening therein that is of such dimension that when the film chip is slightly bowed widthwise, it will be firmly engaged between diagonally opposite corners, i.e., vee-grooves, of the opening.

Another aspect of the carriages of the present invention concerns the shaping of the vee-grooves by which the film chips are held on the carriages for the purpose of assuring that the film chips will be dried upon passing through the drying compartment of the processor.

Thus, in the film chip processor disclosed in the previously mentioned Zwettler patent, when standard film chips are lifted from the rinse tank and pushed into the vee-grooves of the rotating rollers in the dryer, they are always moving relative to the sides of their vee-grooved path. Consequently, globules of rinse solution that are adhering to the edges of the film chips are quickly diminished in size as they wet the sides of the vee-grooved paths so that the film chips can be readily dried by the hot air blowing therepast. However, when a carriage carrying film chips is lifted from the rinse tank and into the dryer, the globules of rinse solution remain on the stationary sidewalls of the vee-grooves on the frame holder of the carriage and adhere to the marginal edges of the film chips. Thus, the dryer of the basic processor which has been adequate for the standard size film chips is not able to dry the odd-size film chips being carried by the carriages with the result that the emulsion surfaces of the film chips will be damaged when they are handled upon emerging from the processor. To overcome this difficulty, the vee-grooves used for holding the film chips on the carriages are especially shaped to minimize the size of the globules of rinse solution that are initially attracted to the vee-grooves and therefore the edges of the film chips.

Accordingly, the object of the present invention is to provide carriages for transporting odd-size film chips through a film chip processor that has been especially adapted to handle standard size film chips.

Another object of the present invention is to shape the vee-grooves used for holding odd-size film chips on carriages movable through a processor such that the odd-size film chips can be dried by the same dryer provided for standard size film chips movable through the processor.

With these and other objects in view, the invention consists of the construction, arrangement and combination of the various parts of the device whereby the objects contemplated are obtained as hereinafter set forth, pointed out in the appended claims and illustrated in the accompanying drawings.

DESCRIPTION OF SETTING FOR THE INVENTION

Before proceeding with a detailed description of the present invention, the basic film chip processor disclosed in the aforementioned patent will be described with reference to FIGS. 1, 3 and 19 of the drawings in order to provide a setting for the description of the present invention to follow.

Figures 1, 2:
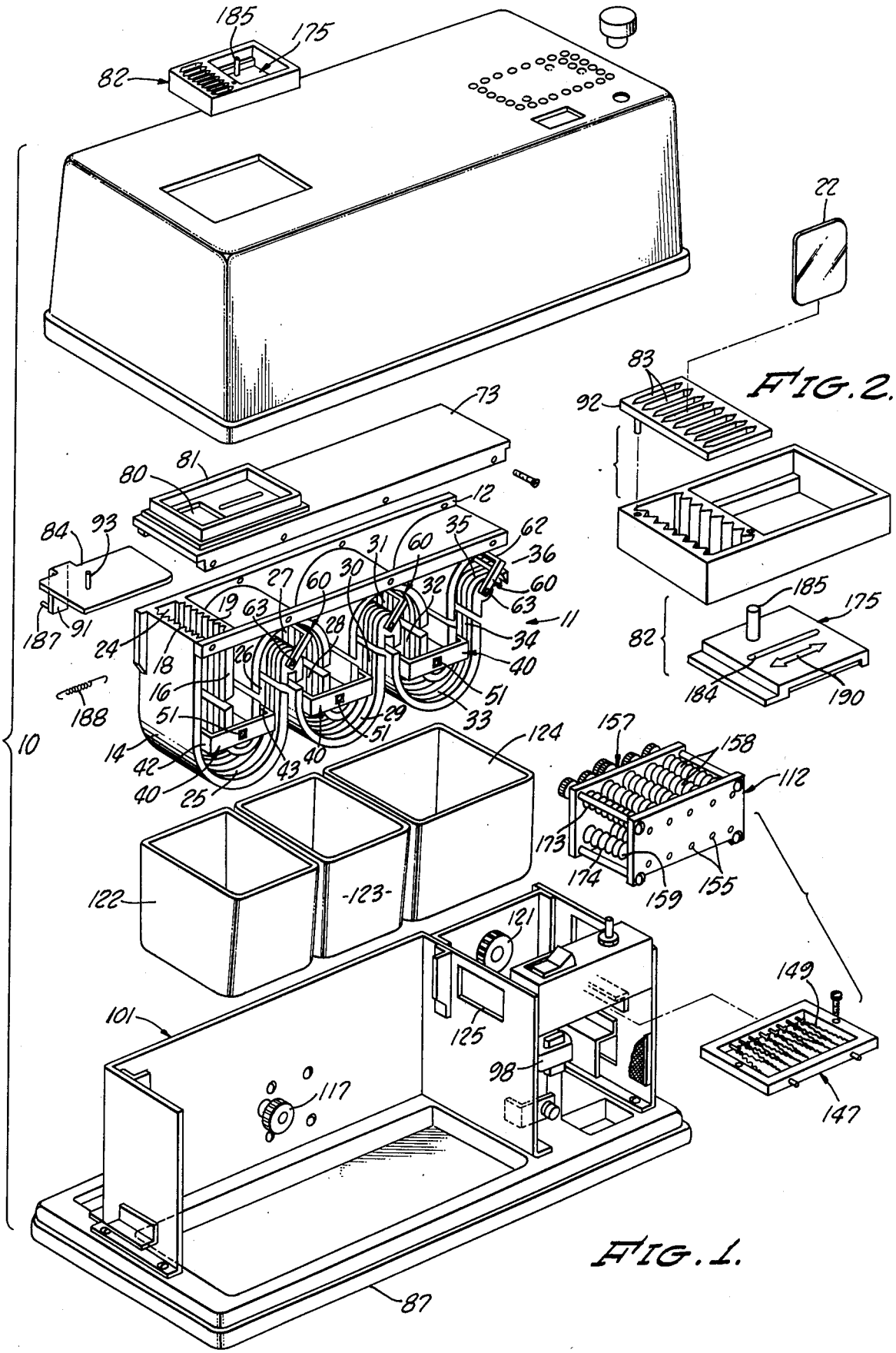
FIG. 1 is an exploded view of the component parts of the film processor with which the film chip carriages of the present invention may be used.
FIG. 2 is an enlarged perspective view of the magazine for the film processor of FIG. 1.
Figure 3:
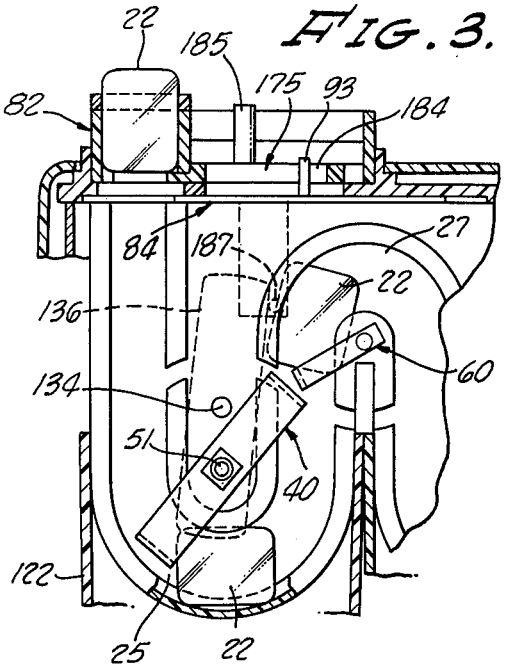
FIG. 3 is a front elevation view of the entrance portion of the film processor with the front walls of the housing cover and the first tank cut away.

Referring to FIG. 1, the component parts are shown of the basic dental film chip processor 10. These component parts include a film chip transport unit 11 comprised of a molding having a vertical rearwall 12 with laterally extending, spaced, parallel, outer and inner curved walls 14 and 16, respectively, forming a channel with three downwardly extending open loop portions. The channel formed by the outer and inner walls 14 and 16 comprises a vertical entrance passage 24 leading down into a first lower semicircular portion 25 which curves up into a vertical portion 26 leading into a first upper semicircular portion 27. The upper semicircular portion 27 then curves down into a vertical portion 28 leading down into a second lower semicircular portion 29 which curves up into a vertical portion 30 leading into a second upper semicircular portion 31. The second upper semicircular portion 31 then curves down into a vertical portion 32 leading into a third lower semicircular portion 33 which curves up into a vertical portion 34 leading into an upper quartercircular portion 35 that leads into a horizontal exit passage 36.

The opposing lateral surfaces of the channel formed by the outer and inner curved walls 14 and 16 each have eight vee-grooves 18 and 19, respectively, extending along the length thereof. Each pair of opposing vee-grooves 18 and 19 serves to engage opposite edges of a small flexible vertically disposed film chip 22 (FIG. 3) being advanced through the transport unit 11.

Three lower lifters 40, each having laterally extending arms 42 and 43, are respectively mounted to rotate about the axes of their respective shafts 51 disposed at the center of each of the lower semicircular portions 25, 29 and 33 of the channel. Three upper lifters 60, each having a single laterally extending arm 62, are respectively mounted to rotate about the axes of their respective shafts 63 disposed at the center of each of the upper semicircular portions 27 and 31 and the quatercircular portion 35 of the channel. The lower and upper lifters 40 and 60 cooperate to raise the film chips 22 along the rising portions of the vee-grooved paths formed by the channel.

Figure 19:
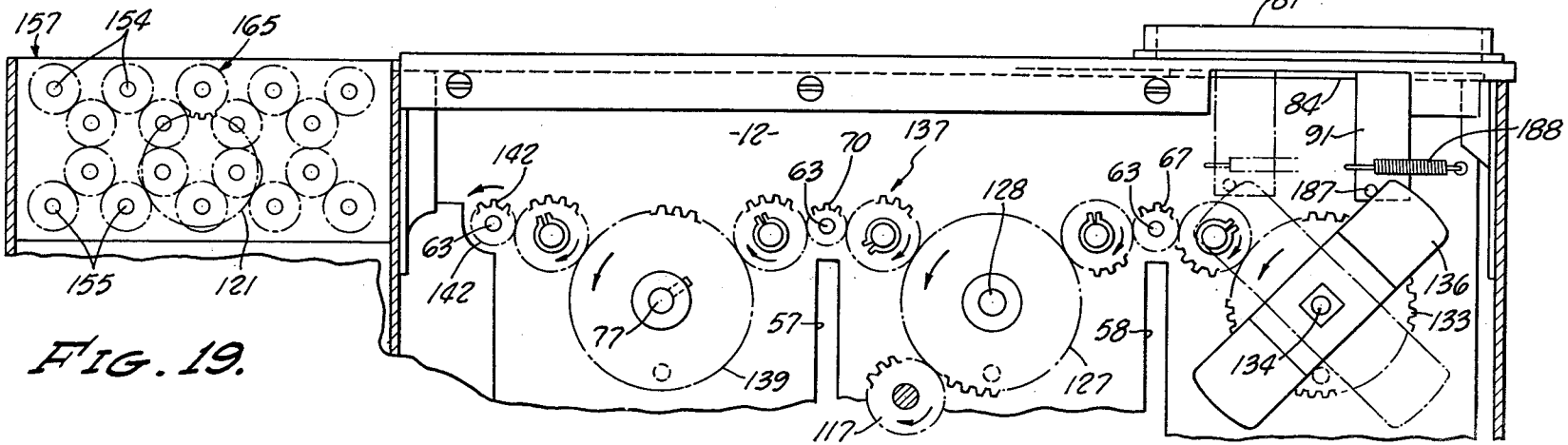
FIG. 19 is a rear view of the film transport unit showing the gear train mounted thereon.

As shown in FIG. 19, a gear train 137 for rotating the lower lifters 40 and the upper lifters 60 is provided on the back of the rearwall 12 of the transport unit 11. The gear train 137 includes three large gears 127, 133 and 139 which are intercoupled by gears, as shown, such that when the large gear 137 is rotated by a drive gear 117 driven by a motor (not shown) all three of the large gears 127, 133 and 139 simultaneously rotate about their respective shafts 128, 134 and 77. These latter shafts are coupled, in turn, by gears to simultaneously rotate the three lower lifters 40 at the same rate about the axes of their respective shafts 51. The large gears 127, 133 and 139 are further coupled, as shown, to rotate the gears 142, 70 and 67 to thereby simultaneously rotate the three upper lifters 60 at the same rate about the axes of their respective shafts 63. The ratio of the gears in the gear train 137 is such that the upper lifters 60 rotate four times as fast as the lower lifters 40.

When the transport unit 11 is lowered into an inner housing 101 which is mounted on a base 87, the lower semicircular portions 25, 29 and 33 thereof respectively fit into the three tanks 122, 123 and 124, and the exit passage 36 of the channel is aligned with the entrance opening 125 into the drying compartment on the right end of the inner housing 101. A roller drive unit 112 located in the drying compartment includes five transversely disposed upper rollers 158 rotatable on respective shafts 154 and five transversely disposed lower rollers 159 rotatable on respective shafts 155. The vertically spaced upper and lower rollers 158 and 159 are formed with eight vee-grooves 173 and 174, respectively.

As shown in FIG. 19, a gear train 165 for the roller drive unit 112 is located on the back of the support 157 for the rollers 158 and 159. The drive gear 121 of the gear train 165 when driven by a motor (not shown) provides for simultaneously rotating gears on the shafts 154 and 155 of the upper and lower rollers 158 and 159 to advance vertically disposed films chips 22 being firmly held edgewise between their respective pairs of vee-grooves 173 and 174.

Figures 11, 12, 13, 14, 15:
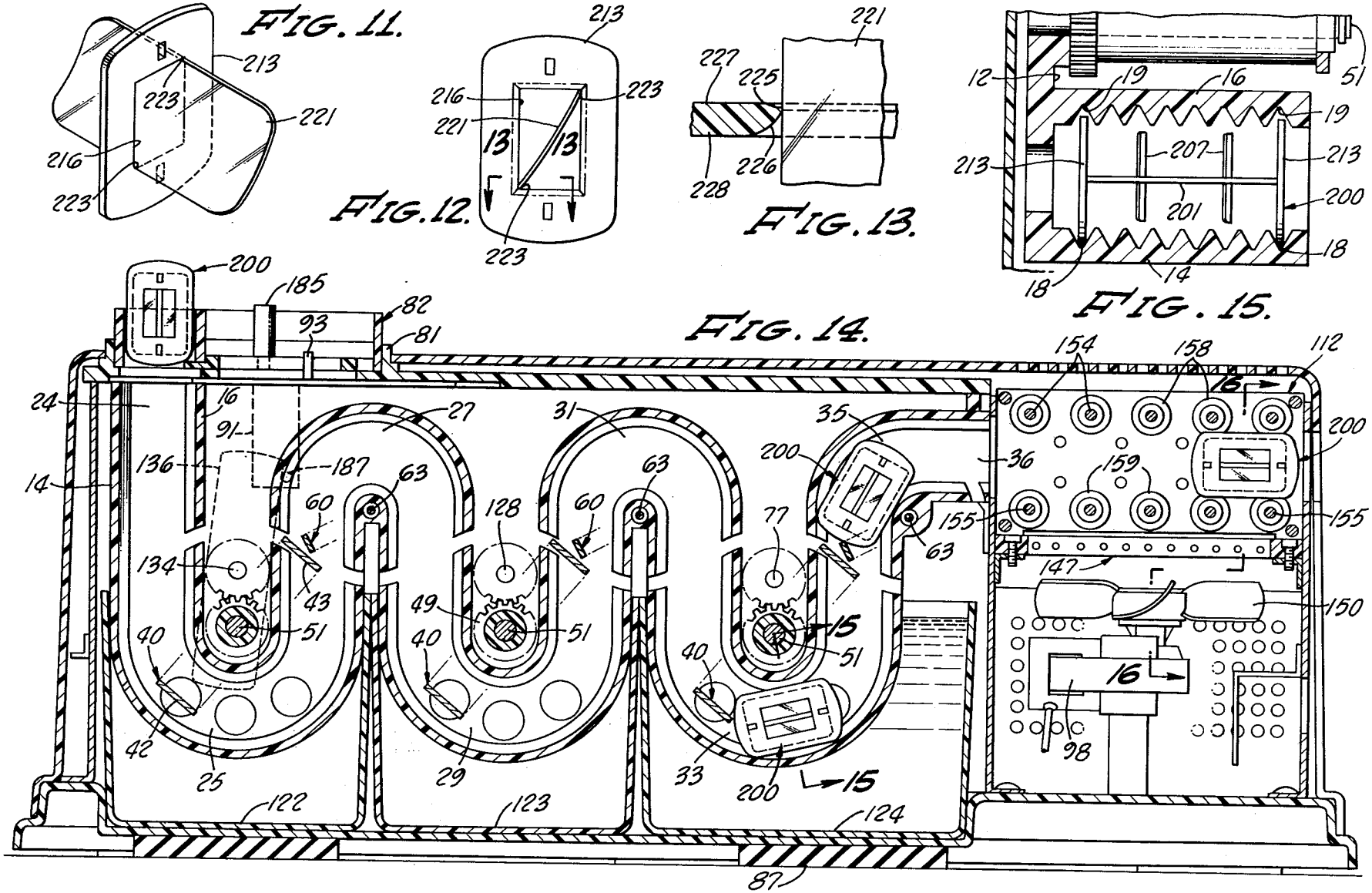
FIG. 11 shows a single support member being used to convey a longer film chip.
FIG. 12 is a side view of the support member shown in FIG. 11.
FIG. 13 is a section taken along line 13—13 in FIG. 12.
FIG. 14 is a longitudinal sectional view of the film processor showing the carriages of FIG. 4 being introduced into and advanced therethrough.
FIG. 15 is a sectional view taken along line 15—15 in FIG. 14.

Mounted on the base of the drying compartment below the roller drive unit 112 is a motor 98 which drives a fan 150 (FIG. 14). A heater device 147 having a plurality of heating coils 149 extending thereacross is positioned above the fan 150. Thus, as the film chips 22 are advanced through the roller drive unit 112 they are dried by the hot air blown therepast by the fan 150.

In order to load the film chips 22 into the processor, a rectangular shaped reciever 81 for a magazine 82 is provided on the left end of the top member 73 of the transport unit 11. The receiver 81 has a rectangular opening 80 aligned with the vertical entrance passage 24 into the channel. The magazine 82 (FIG. 2) includes a top plate 92 provided with eight parallel slots 83 which are located above the opening 80 in the receiver 81 in alignment with the respective pairs of vee-grooves 18 and 19 in the opposing walls of the channel. A stopping plate 175 located to slide in recesses on the bottom of the magazine 82 is initially moved to its left hand position (FIG. 3) to prevent the film chips 22 from dropping during loading of the magazine.

A gate member 84 is disposed to slide in a recess provided on the underside of the receiver 81. The backside of the gate member 84 has a vertical extension 91 provided with a pin 187. A spring 188 normally holds the gate member 84 toward the left to close the entrance passage 24. A rotating cam 136 (FIGS. 3 and 19) is attached to shaft 134 and is thus synchronized to rotate with the first lower lifter 40. With the magazine loaded with film chips 22, the stopping plate 175 is moved to its right hand position while the pin 92 is being slowly moving to the right in slot 184 as a result of the outer side surface of the cam 136 contacting the pin 187. When the gate member 84 has been forced by the cam 136 to its extreme right position, the opening 80 is cleared so that film chips 22 stored in the slots 83 of the magazine 82 drop down into the channel. After the outer side surface of cam 136 rotates past the pin 187, the gate member 84 is released and pulled back by the spring 188 to close the opening 80. It should now be clear that successive batches of the standard size film chips 22 can be loaded in the magazine 82 and dropped at the proper time down into the entrance passage 24 of the channel and into the first tank 122 from which they are transported by the lower and upper lifters 40 and 60 to the successive tanks 122, 123 and 124, and then to the roller drive unit 112 in the dryer.

Having described the basic film chip processor disclosed in the aforementioned patent and the nature of the loading and movement of the standard size film chips therethrough, it will now be expedient to consider a preferred embodiment of the present invention in connection with FIGS. 4 to 18, inclusive.

DETAILED DESCRIPTION OF THE INVENTION

The preferred embodiment of the carriage 200 of the present invention, as shown in FIGS. 4 to 8, inclusive, includes a plastic film chip holder 201 having plastic support members 213 attached to the ends thereof. The film chip holder 201 is in the form of a flat rectangular rigid frame having a thickness on the order of fifty thousandths (0.050) of an inch. The holder 201 has six vee-grooves 204 and 205 respectively formed along the inner edges of the sides 202 and 203 thereof. Pairs of opposing vee-grooves 204 and 205 serve to engage the edges of odd-size film chips 207 that are slightly bowed lengthwise. The film chips 207 are so engaged midway of the widths thereof. An integrally formed connecting strip 208 joins the center of the sides 202 and 203 of the frame together to maintain the spacing of the pairs of opposing vee-grooves 204 and 205. This center connecting strip 208 is narrowed down in its central portion 210 so as to assure that the surfaces of the bowed film chips 207 when placed in the vee-grooves in the center of the holder such as to bow toward the strip 208 do not contact the surface of the strip 208. The film chip holder 201 has ears 212 formed on its ends adjacent the corners thereof. The support members 213 are in the form of generally rectangular flat plates which have a thickness on the order of fifty thousandths (0.050) of an inch. Support members 213 have slots 215 therein aligned to receive the ears 212 on the ends of the film chip holder 201 when the support members are transversely disposed relative to the plane of the holder 201. The ends of the ears 212 may be peened by heat to hold the parts together. It should be noted that the support members 213 have a shape generally conforming with the shape of the standard size film chips 22. Actually, the support members 213 are much thicker than the film chips 22. Consequently, the widths of the support members 213 may be made slightly smaller to assure that their sides can freely fit between pairs of opposing vee-grooves 18 and 19 of the transport unit 11 shown in FIG. 1. Furthermore, the support members 213 may be made a little longer than the film chips 22 to enable the film chip holder 201 to be made wider to accomodate longer odd-size film chips between its pairs of opposing vee-grooves 204 and 205. Note that the width of the holder 201 is smaller than the length of the support member 213 in FIG. 4.

Figure 8:
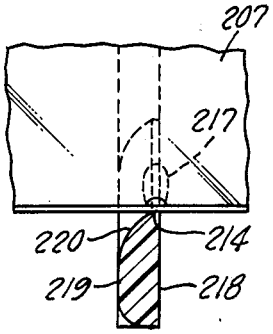
FIG. 8 is a section taken along line 8—8 of FIG. 7.
Figure 7:
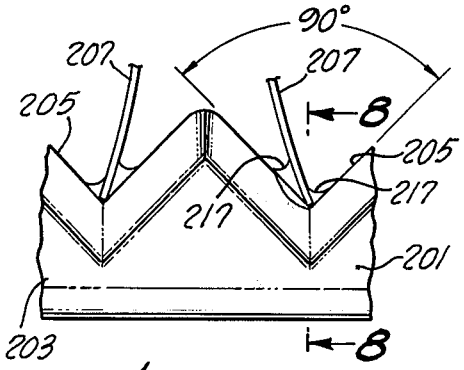
FIG. 7 is an enlarged view of the vee-grooves on the film chip carriage within the circle 7 in FIG. 4 showing globules of rinse solution being retained thereon upon being transferred from the rinse tank to the dryer.
Figure 9:
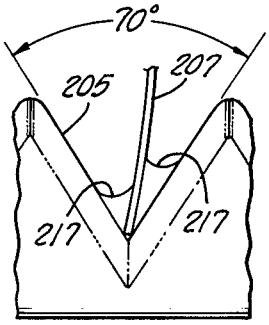
FIG. 9 is a view showing globules of rinse solution being retained on a carriage provided with smaller angle vee-grooves.

Referring to FIGS. 7 and 8, the vee-grooves 204 and 205 on the inner edges of the sides 202 and 203 of the holder 201 are formed with a flat 214 of approximately three to five thousandths of an inch near one of the plane surfaces 218 of the holder 201 followed by a bevel of radius 220 which extends from the edge of the flat 214 to the opposite plane surface 219 of the holder.

It should now be understood, as illustrated in FIG. 7, that when the carriage 200 is moved by the lower and upper lifters 40 and 60 out of the last tank 124 of the processor, globules 217 of the rinse solution adhere on either side of the marginal edge of the film chip 207 residing in the vee-grooves on the holder 201. However, as illustrated in FIG. 8, the forming of a small flat 214 near one plane surface of the vee-groove and the beveling of the remaining thickness of the vee-groove with a radius 220 causes the globules 217 to form only between the portion of the vee-groove adjacent the flat 214 and the film chip 207. Consequently, the globules 217 are much smaller that they would be if the flat 214 were to extend the full thickness of the film chip holder 201, i.e., if the radius 220 were not provided.

As shown in FIG. 7, the vee-grooves 205, as well as vee-grooves 204, on the holder 201 are formed with sides having an included angle of 90°. As noted, in FIG. 9, a vee-groove **205*a* is shown which is formed with sides having a 70° included angle, for example. Narrowing the angle of the vee-groove causes the side surfaces thereof and the surfaces of the film chip 207 to be closer together. This causes larger globules 217 of solution to adhere to the crevices formed by the film chips 207 and the sides of the vee-grooves. Thus, the included angle of the vee-groove 205 is preferably made 90° or greater to help minimize the size of the globules 217 of solution retained thereon when the carriage 200 is moved out of the rinse tank 214**.

Figure 5:
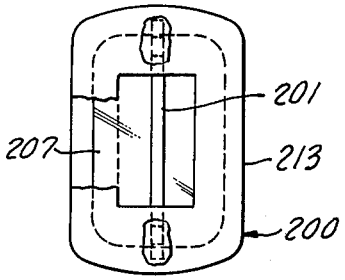
FIG. 5 is an end view of the film carriage of FIG. 4.
Figure 6:
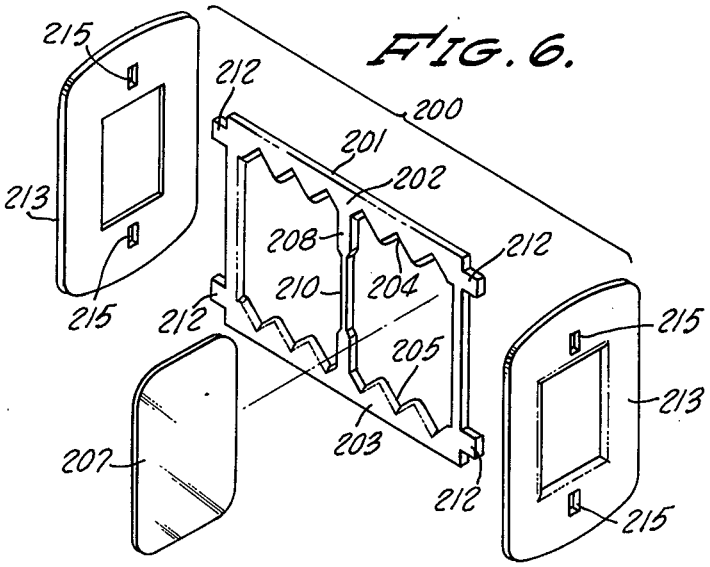
FIG. 6 is an exploded view of the parts of the film chip carriage shown in FIG. 4.
Figure 10:
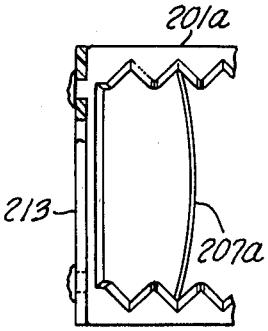
FIG. 10 shows a modified embodiment of the carriage of FIG. 4.

FIG. 10 shows how a film chip holder **201*a* whose width is equal to the length of the support member 213, can be provided between the support members 213 to enable the spacing of the pairs of opposing vee-grooves on the holder to be further apart such that longer film chips 207*a* can be inserted therein. It should be appreciated that the film chip holder 201*a* cannot be wider that the length of the support member 213 since the lateral arms of lifters 40 and 60 must contact the ends of the support members 213 and not the film chip holder. Furthermore, it is desirable for the corners and ends of the support members 213 to be rounded, as illustrated in FIG. 5, to facilitate the sliding of the lateral arms of the lifters 40 and 60 therealong as they push the carriages 200** through the channel.

As shown in FIG. 11, a support member 213 can itself serve as a carriage by providing a central rectangular opening 216 therein. This opening 216 is of such a size that a slightly lengthwise bowed long film chip 221 can be inserted therein and held midway of its length in the vee-grooves formed by the diagonally opposing corners 223 thereof. In order to reduce the size of the globules of solution that will adhere to the edges of the long film chip 221 located in the corners 223 of the rectangular opening 216, the edges of the rectangular opening 215 are shaped similarly to the vee-grooves 205 on the film chip holder 201 of the carriage 200 in FIG. 4. Thus, as shown in FIG. 13, the edges of opening 216 are formed with a flat 225 of three to five thousandths of an inch near one plane surface 227 of the support member 213 and with the remainder of the thickness of the support member 213 rounded with a radius 226 to the other plane surface 228 thereof, as shown in FIG. 13.

It should be understood that when a support member 213 itself serves as a carriage, its central opening may be enlarged and shaped such that more than one pair of opposing vee-grooves are provided therein. In this way the support member 213 can be adapted to carry more than one film chip 221.

Now that the preferred embodiments of the carriages for the odd-size film chips have been described in connection with FIGS. 4 to 13, it will next be described how these carriages cooperate with the basic film chip processor previously described in connection with FIG. 1 so as to permit convenient transportation of the odd-size film chips through the processor for processing thereby.

Figure 4:
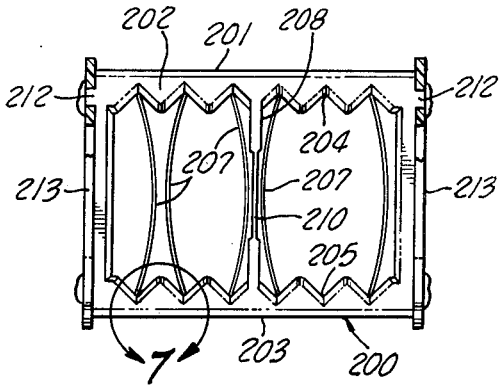
FIG. 4 is a top view of a preferred embodiment of the film chip carriage of the present invention adapted to operate with the film processor of FIG. 1.

Referring to FIG. 14, it should now be evident that with the magazine top member 92 (FIG. 2) provided with slots 83 removed from the magazine 82 of the film processor of FIG. 1, a carriage 200, such as shown in FIG. 4, carrying odd-size film chips 207 in its holder 201 can be positioned in the mouth of the channel. When so positioned, the width edges of the support members 213 freely engage the outer-most pairs of opposing vee-grooves 18 and 19 of the channel, as illustrated in FIG. 15, for example.

Figure 16:
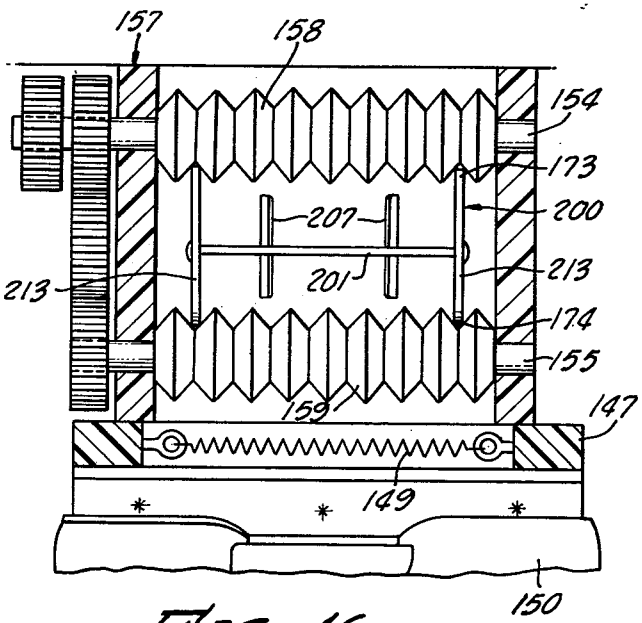
FIG. 16 is a sectional view through the dryer taken along lines 16—16 of FIG. 14.

Now then, when the magazine 82 is cocked by pushing the pin 185 to the right in FIG. 14, any time during the period of time that the pin 93 is within the range of arrows 190 on the stopping plate 175 (FIG. 2), at the instant the gate member 84 is moved back by the cam 136 to open up the magazine 12 the carriage 200 is permitted to slip down into the entrance passage 24 of the channel and into the first tank 122. It should be evident that each half cycle of the lower lifter 40, a new carriage 200 can be inserted in and automatically dropped from the magazine 82 into the tank 122. Each carriage 200 is then successively advanced from tank 122 to the succeeding tanks 123 and 124 by the sets of lower and upper lifters 40 and 60. Upon the carriage 200 being lifted out of the last tank 124 by the last lower lifter 40, the carriage 200 is pushed by the last upper lifter 60 into the drying compartment where its support members 213 are tightly engaged between the opposing vee-grooves 173 and 174 of the driven rollers 158 and 159, as shown in FIG. 16. As previously described, because of the beveling of the vee-grooves 204 and 205 on the film chip holder 201, the globules 217 of solution which are retained on the edges of the film chip 207 in the vee-grooves 205 are small such that they are readily evaporated by the hot air provided in the dryer by the fan 98 blowing past the heater coils 149.

Figure 18:
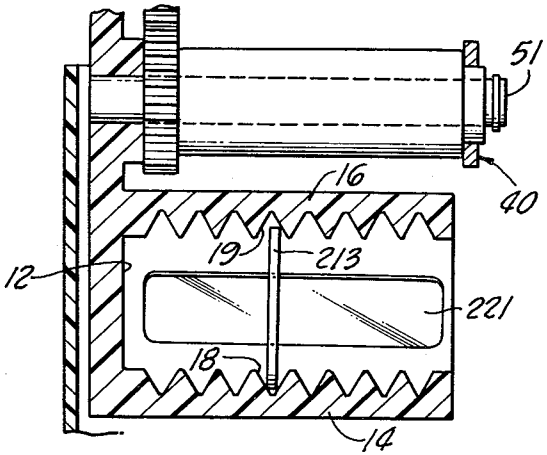
FIG. 18 is a sectional view taken along line 18—18 of FIG. 17.
Figure 17:
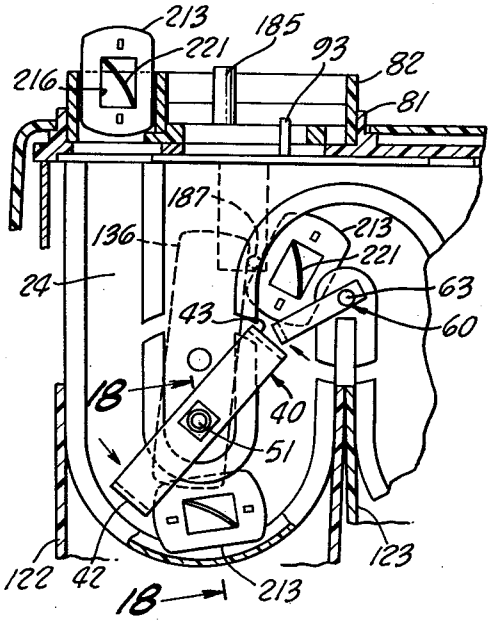
FIG. 17 is a view similar to FIG. 3 showing the carriages of FIG. 11 being introduced into and advanced through the processor.

The loading and transporting of a support member 213 through the processor of FIG. 1 when it is used by itself for carrying a long film chip 221 is shown in FIGS. 17 and 18. As noted in FIG. 18, the single support member 213 is engaged within one pair of the opposing vee-grooves 18 and 19 located in the center portion of the channel. The long film chip 221 has its side edges engaged in diagonally opposite corners 223 of the rectangular opening 216 in support members 213 and extends laterally from each side thereof into the open space within the channel.

Similarly to the carriage 200, the single support members 213 when used as carriages can be loaded one at a time into the processor each half cycle of the lower lifters 40 and advanced along the channel. Thus, FIG. 17 shows a first single support member 213 holding a film chip 221 being lifted along the channel by the arm of the first upper lifter 60 over into the second tank 123, a second single support member 213 holding a film chip 221 being advanced along the channel through the first tank 122 by the arm 42 of the first lower lifter 40, while a third single support member 213 holding a film chip 221 is positioned in the magazine 82 which has been cocked to enable it to be dropped as the arm 42 of the first lower lifter 40 descends into the first tank 122.

It should now be clearly understood that the magazine 82 can be successively loaded every half cycle of the first lower lifter 40 with either standard size film chips 22, a carriage 200 having odd-size film chips secured thereon, or a single support member 213 when used as a carriage for a single odd-size film chip, to thereby enable both standard and odd-size film chips to be processed by the processor disclosed in connection with FIG. 1.

While the foregoing disclosure has been concerned with certain illustrative embodiments, it is to be understood that the invention is susceptible of many modifications and variations in both the construction and arrangement, as well as being subject to uses other than those described herein. The present invention, therefore, is not to be considered as limited to the specific disclosure provided herein, but is to be considered as including all modifications and variations coming within the scope of the invention as defined in the appended claims.

What is claimed is:

1. In a processor for dental film chips wherein a channel is provided having curved portions extending down into and out of successive tanks of solution, said channel having pairs of opposing vee-grooves lying in the same vertical planes forming paths through the channel in which vertically oriented standard size film chips are freely engaged by their edges, and lifting means for moving said standard size film chips along rising portions of the channel, the combination with the processor of carriages for conveying odd-size film chips through the channel, said carriages including support members in the form of vertically oriented thin plates having sizes corresponding to the standard size film chips, wherein each said carriage is formed of a single one of said support members having a rectangular opening in the central portion thereof of a size to enable an odd size film chip bowed along one dimension thereof to be inserted so as to extend transversely of the support member with the opposite side edges engaging diagonally opposite corners thereof, whereby said carriages can be introduced into said channel with their support members freely engaged by pairs of opposing vee-grooves and can be moved by said lifting means along said channel in the same manner as said standard film chips.

2. The invention in accordance with claim 1 wherein the edges of said rectangular opening are beveled.

3. In a processor for dental film chips wherin a channel is provided having curved portions extending down into and out of excessive tanks of solution, said channel having pairs of opposing vee-grooves lying in the same vertical planes forming paths through the channel in which vertically oriented standard size film chips are freely engaged by their edges, and lifting means for moving said standard size film chips along rising portions of the channel, the combination with the processor of carriages for conveying odd size film chips through the channel, said carriages including support members in the form of vertically oriented thin plates having sizes corresponding to the standard size film chips, wherein each said carriage includes a frame having pairs of vee-grooves on the opposite inner sides thereof in which bowed odd-size film chips can be secured by their edges, and one of said support members is attached to either end of the frame, whereby said carriages can be introduced into said channel with their support members freely engaged by pairs of opposing vee-grooves and can be moved by said lifting means along said channel in the same manner as said standard size film chips.

4. The invention in accordance with claim 3 wherein the edges of the said vee-grooves on said frame are beveled.

5. The invention in accordance with claim 3 wherein a center strip is provided for connecting said inner sides of the frame together.

6. The invention in accordance with claim 5 wherein the center strip is further narrowed in the central portion thereof.

7. The invention in accordance with claim 3 wherein the vee-grooves formed on said frame are 90° or greater.

8. In a processor for dental film chips wherein a channel is provided having curved portions extending down into and out of successive tanks of solution, said channel having pairs of opposing vee-grooves lying in the same vertical planes forming paths through the channel in which vertically oriented standard size film chips are freely engaged by their edges, and lifting means for moving standard size film chips along rising portions of the channel, the combination with the processor of carriages for conveying odd-size film chips through the channel, said carriages including support members in the form of vertically oriented thin plates having sizes corresponding to the standard size film chips, wherein each said carriage is formed of a single one of said support members with an opening in the central portion thereof having at least one pair of opposing vee-grooves spaced to enable an odd-size bowed film chip to be inserted therebetween so as to extend transversely to the support member, the edges of said vee-grooves being beveled, whereby said carriages can be introduced into said channel with their support members freely engaged by pairs of opposing vee-grooves and can be moved by said lifting means along said channel in the same manner as said standard size film chips.

9. In a processor for dental film chips wherein a channel is provided formed of a pair of laterally extending parallel spaced walls having lower curved portions extending down into and out of a series of tanks and upper curved portions extending from each tank to the succeeding tank, said channel having a pluraity of vee-grooves formed on the opposing surfaces thereof with pairs of opposing vee-grooves lying in the same vertical plane forming paths through the channel for vertically oriented standard size film chips, a lower lifter mounted for rotation in each lower curved portion of the channel and an upper lifter mounted for rotation in each upper curved portion of the channel, each said lower lifter timed to rotate with an upper lifter so that when said lower lifter lifts film chips along their paths out of a tank the upper lifter continues to lift the film chips and transfers them along their paths into the succeeding tank, the combination with said processor of a carriage for odd-size film chips, said carriage including a frame having pairs of vee-grooves on the opposite inner sides thereof in which bowed odd-size film chips can be secured, and support members in the form of thin plates attached on the ends of said frame, said support members having a size corresponding to the size of the standard size film chip so that when the frame of said carriage is loaded with odd-size film chips the carriage can be inserted into said channel with its support members engaged in pairs of opposing vee-grooves thereof and advanced by said lifters along the paths thereof in the same manner as said standard size film chips.

10. The invention in accordance with claim 9 wherein said frame has plane surfaces and a thickness on the order of fifty thousandths of an inch, and the edge of the vee-grooves on its inner sides are formed with a flat of three to five thousandths of an inch adjacent one of the plane surfaces thereof and with the remainder of the thickness thereof between the end of the flat and the opposite plane surface beveled.

11. In a processor for dental film chips wherein a channel is provided formed of a pair of laterally extending parallel spaced walls having lower curved portions extending down into and out of a series of tanks and upper curved portions extending from each tank to the succeeding tank, said channel having a plurality of vee-grooves formed on the opposing surfaces thereof with pairs of opposing vee-grooves lying in the same vertical planes forming paths through the channel for vertically oriented standard size film chips, a lower lifter mounted for rotation in each lower curved portion of the channel and an upper lifter mounted for rotation in each upper curved portion of the channel, each said lower lifter timed to rotate with an upper lifter so that when said lower lifter lifts film chips along their paths out of a tank the upper lifter continues to lift the film chips and transfers them along their paths into the succeeding tank, the combination with said processor of carriages for odd-size film chips, each said carriage including a planar support member having a size corresponding to a standard size film chip, said support member provided with an opening having spaced apart opposing vee-grooves on the periphery thereof into which a bowed odd-size film can be inserted and held so as to extend transversely to the plane of the support member, whereby said carriage carrying an odd-size film chip can be introduced into said channel with its support member engaged by a pair of the opposing vee-grooves therein and advanced by said lifters along the path thereof in the same manner as a standard size film chip.

12. In a processor for dental film chips wherein a channel is provided formed of a pair of laterally extending parallel spaced walls having lower curved portions extending down into and out of a series of tanks and upper curved portions extending from each tank to the succeeding tank, said channel having a plurality of vee-grooves formed on the opposing surfaces thereof with pairs of opposing vee-grooves lying in the same vertical planes forming paths through the channel for vertically oriented standard size film chips, a lower lifter mounted for rotation in each lower curved portion of the channel and an upper lifter mounted for rotation in each upper curved portion of the channel, each said lower lifter timed to rotate with an upper lifter so that when said lower lifter lifts film chips along their paths out of a tank the upper lifter continues to lift the film chips and transfers them along their paths into the succeeding tank, the combination with said processor of carriages for conveying odd-size film chips through the channel, said carriages including support members in the form of vertically oriented thin plates having a size generally corresponding to a standard size film chip, whereby said carriages can be introduced into said channel with their support members freely engaged by pairs of opposing vee-grooves and can be moved by said lifters along the paths thereof in the same manner as said standard size film chips.

13. In a processor for automatically developing film chips wherein a continuous channel is provided having curved portions extending down into and out of successive tanks of solution, said channel having pairs of opposing vee-grooves lying in the same vertical planes forming paths throughout the channel in which vertically oriented generally rectangularly shaped standard size film chips can be introduced so as to be freely engaged by their edges, and lifting means for moving said standard size film chips along rising portions of the channel, the combination with the processor of a carriage for carrying a bowed odd-size film chip by engaging the side edges thereof, said carriage including at least one support member in the form of a vertically oriented generally rectangularly shaped thin plate generally corresponding in size to a standard size film chip, whereby said carriage carrying a bowed odd-size film chip can be introduced into said channel with said support member freely engaged by a pair of the opposing vee-grooves therein and can be moved by said lifting means along said channel in the same manner as said standard size film chips.

14. A processor for automatically developing film chips comprising: a series of tanks of solution, a continuous channel having an input and an output and having curved portions extending down into and out of said tanks, said channel having pairs of spaced opposing vee-grooves lying in the same vertical planes forming paths through the channel, and a carriage for conveying film chips through said channel, said carriage including a planar frame having pairs of opposing vee-grooves on the opposite inner sides thereof in which bowed film chips can be secured by their edges and a pair of spaced planar support members for supporting said frame, the planes of said support members being disposed normal to the plane of the frame, said support members adapted when vertically disposed to be introduced into the inlet of said channel so as to freely engage pairs of opposing vee-grooves in the channel, and lifting means for moving said carriage through rising portions of said channel.

* * * * *